US006779867B2

(12) United States Patent
Shimizu et al.

(10) Patent No.: US 6,779,867 B2
(45) Date of Patent: Aug. 24, 2004

(54) INK JET RECORDING APPARATUS

(75) Inventors: Megumi Shimizu, Mishima (JP); Atsushi Kubota, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/278,120

(22) Filed: Oct. 22, 2002

(65) Prior Publication Data

US 2003/0081045 A1 May 1, 2003

(30) Foreign Application Priority Data

Oct. 26, 2001 (JP) ..... 2001-329400

(51) Int. Cl.[7] ..... B41J 2/165

(52) U.S. Cl. ..... 347/23; 347/29; 347/35; 347/36

(58) Field of Search ..... 347/23, 22, 29, 347/32, 33, 35, 36, 34, 83

(56) References Cited

U.S. PATENT DOCUMENTS 5,177,505 A 1/1993 Sugiura et al.
5,659,342 A 8/1997 Lund et al.
5,717,446 A 2/1998 Teumer et al.
5,903,288 A 5/1999 Yamaguchi
6,283,577 B1 * 9/2001 Kosaka et al. ..... 347/35
6,619,784 B2 * 9/2003 Bauer ..... 347/35
6,663,216 B2 * 12/2003 Kanaya ..... 347/23

FOREIGN PATENT DOCUMENTS

JP 9-254375 A 9/1997

* cited by examiner

*Primary Examiner*—Shih-Wen Hsieh
(74) *Attorney, Agent, or Firm*—Frishauf, Holtz, Goodman & Chick, P.C.

(57) ABSTRACT

There is disclosed an ink jet recording apparatus which performs printing on a recording medium to be subjected to processing such as pasting and folding after the printing, including an ink jet head in which a plurality of ink discharge nozzles are arranged to cross with respect to a conveyance direction of the recording medium, a spit position determining unit which determines a spit position based on size information and unexposed region information of the recording medium, and a spit control unit which controls spit of the ink jet head based on a spit position determining result of the spit position determining unit. Here, the unexposed region information defines regions on the recording medium surface which are unexposed or cut away after printing and processing.

8 Claims, 8 Drawing Sheets

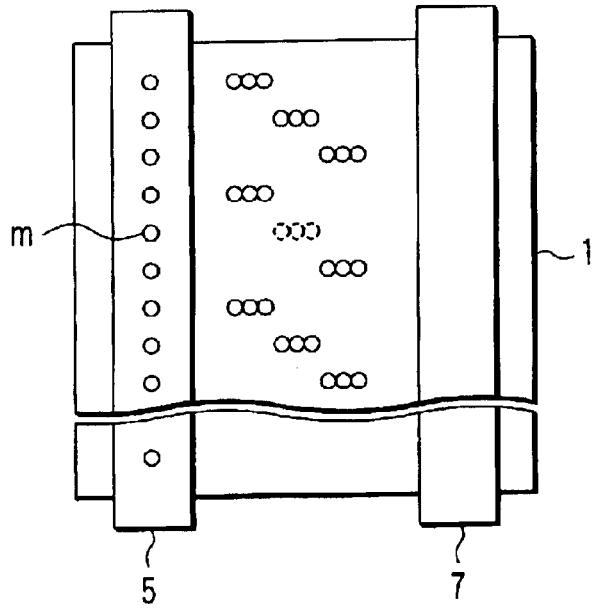
FIG. 12
FIG. 13A
FIG. 13B
FIG. 13C
FIG. 13D
FIG. 13E
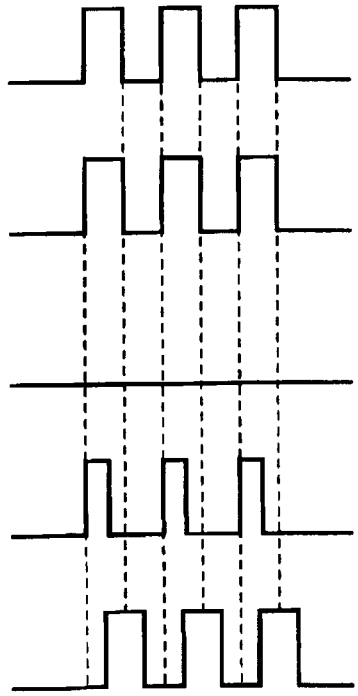

INK JET RECORDING APPARATUS

CROSS-REFERENCE TO RELATED APPLICATIONS

This application is based upon and claims the benefit of priority from the prior Japanese Patent Application No. 2001-329400, filed Oct. 26, 2001, the entire contents of which are incorporated herein by reference.

BACKGROUND OF THE INVENTION

1. Field of the Invention

The present invention relates to an ink jet recording apparatus in which an ink jet head including a plurality of ink discharge nozzles arranged to cross with respect to a conveyance direction of a recording medium is used to record an image on the recording medium.

2. Description of the Related Art

A known example of an ink jet recording apparatus is an on-demand type ink jet printer. In the ink jet printer, there is a problem that a nozzle is clogged and non-discharge or defective discharge of ink occurs because of adhesion of the ink in the nozzle in an ink jet head and paper dust of a recording medium.

To avoid this and steadily discharge ink, during the starting of the recording apparatus, before and after the recording, or during the recording, the ink jet head is moved to a maintenance station. Moreover, in the maintenance station, the head is maintained by a method of spitting the ink to an ink absorption material, a method of sucking the ink in the nozzle, or a method of wiping the ink on a nozzle tip end.

However, the ink jet recording apparatus is used to perform printing such as industrial printing in which productivity is very important. In this case, when the ink jet head is periodically moved to the maintenance station and subjected to maintenance, a drop of productivity become to be a problem.

On the other hand, as described in Jpn. Pat. Appln. KOKAI Publication No. 9-254375, when the ink jet head requires the maintenance by ink discharge, without moving the ink jet head to the maintenance station, the ink is spitted to a margin trimmed as unnecessary on the recording medium. Thereby, in the publication, the productivity is enhanced.

Moreover, as a generally known method of detecting a defective nozzle, when the non-discharge or defective discharge of the ink occurs, a method comprises: recording a nozzle check pattern on the recording medium or another recordable place in order to check the ink discharge from each nozzle; and reading and detecting the recorded nozzle check pattern.

However, the above-described publication has a constitution in which only the margin to be trimmed on the recording medium is used to perform the ink spit. Therefore, when the margin to be trimmed does not exist on the recording medium, the ink cannot be spitted. In this case, the ink jet head is periodically moved to the maintenance station and a usual maintenance is performed. There is a problem that an efficiency of maintenance drops and the productivity cannot be enhanced.

Particularly, for the ink jet head, with the use of the ink jet head in which a plurality of ink discharge nozzles are arranged to cross with respect to the conveyance direction of the recording medium, of course when the margin to be trimmed does not exist on the recording medium, and even when the margin to be trimmed exists, but when the margin to be trimmed does not exist entirely over a direction crossing at right angles to the conveyance direction of the recording medium, the spit cannot be performed with respect to all the ink discharge nozzles. Even in this case, the ink jet head is periodically moved to the maintenance station and subjected to the maintenance, and there is a problem that the efficiency of maintenance drops and the productivity cannot be enhanced.

Moreover, to record the nozzle check pattern for checking the ink discharge from each nozzle, when the recording medium is used to record the nozzle check pattern, the recording medium is sacrificed and therefore the productivity drops. Moreover, when the nozzle check pattern is recorded on a recordable place other than the recording medium, the ink jet head is moved to the place, and there is still a problem that the efficiency of maintenance drops and the productivity cannot be enhanced.

BRIEF SUMMARY OF THE INVENTION

An object of the present invention is to provide an ink jet recording apparatus which can enhance an efficiency in performing maintenance by spitting or recording of a nozzle check pattern with use of an ink jet head including a plurality of ink discharge nozzles arranged to cross with respect to a conveyance direction of a recording medium.

According to an aspect of the present invention, there is provided an ink jet recording apparatus to perform printing on a recording medium in which two or more unexposed regions subjected to processing such as trimming, pasting and folding after the printing and thereby unexposed exist in a mixed manner, comprising: an ink jet head in which a plurality of ink discharge nozzles are arranged to cross with respect to a conveyance direction of the recording medium; a spit position determining unit which determines a spit position based on size information and unexposed region information of the recording medium; and a spit control unit which controls spit of the ink jet head based on a spit position judgment result of the spit position judgment unit, wherein the unexposed region information defines regions on the recording medium surface which are unexposed or cut away after printing and processing, and the spit position determining unit selects two or more unexposed regions and determines the spit position so that all the ink discharge nozzles perform the spit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 12 is a diagram showing a printing example at a time when the nozzle check pattern is used to perform the spit and a defective nozzle is detected in the second embodiment;

FIGS. 13A to 13E are signal waveform diagrams showing examples of binarized signals of a reference nozzle check pattern and read nozzle check pattern in the second embodiment;

DETAILED DESCRIPTION OF THE INVENTION

Embodiments of the present invention will be described hereinafter with reference to the drawings.

(First Embodiment)

Figure 1:
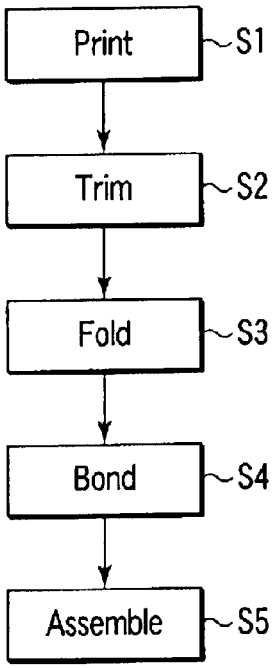
FIG. 1 is a flowchart showing a process from printing to box making and a process from printing to bookbinding, including a printing process to which a first embodiment of the present invention is applied.

FIG. 1 is a flowchart showing a process comprising: recording/printing a recording medium such as a corrugated cardboard and assembling the recording medium into a box. After the recording medium is printed in a print step S1, an unnecessary portion is trimmed from the recording medium in a trim step S2. Subsequently, a portion to be folded is folded in a fold step S3, paste is applied to a margin in an adhesion step S4, and the recording medium is assembled into the box finally in a box making step S5.

For the recording medium for use in this process, one sheet of rectangular or square medium is used. Moreover, a trim region to be trimmed, a paste region to be pasted, and a fold region to be folded are predetermined in the medium. After the printing, the respective regions are trimmed, pasted, folded, and processed otherwise. Therefore, the trim, paste, and fold regions form unexposed regions not exposed to the surface, when the box is finally made.

Figure 2:
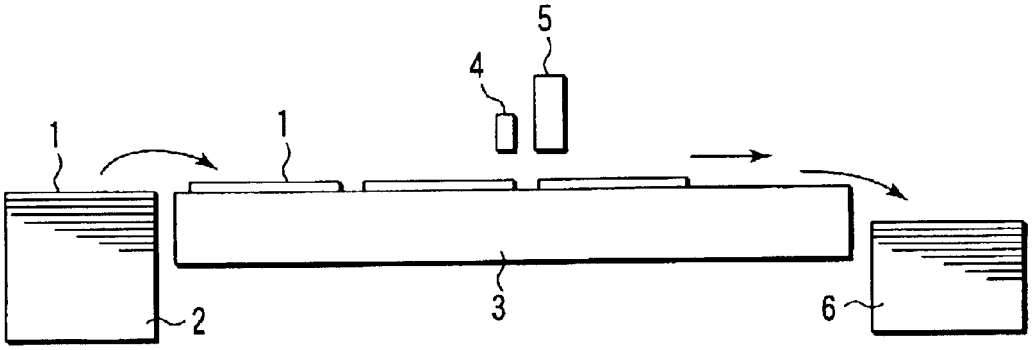
FIG. 2 is a diagram showing a constitution of the printing process according to the first embodiment of the present invention.

FIG. 2 shows a constitution of a printing process. A recording medium 1 is taken out sheet by sheet from a picker unit 2 in which the recording medium 1 such as a corrugated cardboard is stacked, and laid onto a conveyance unit 3. As the conveyance unit 3, a belt or roller is used as conveyance means, so that the recording medium 1 is conveyed sheet by sheet at a predetermined interval in a direction shown by arrows in FIG. 2.

A sensor 4 which detects a top position of the recording medium 1, and an ink jet head 5 are disposed above a middle of the conveyance unit 3. In the ink jet head 5, a plurality of ink discharge nozzles are arranged at predetermined intervals in a direction crossing a direction in which the recording medium 1 is conveyed, for example, in a direction crossing at right angles to the conveyance direction. The interval between opposite end nozzles substantially agrees with a width of the direction crossing at right angles to the conveyance direction of the recording medium 1. Moreover, the recording medium 1 printed by the ink jet head 5 is contained in a stacker unit 6.

In the printing process, the heads the number of which are correspond to the number of ink colors are used. For example, four heads for four colors of cyan, magenta, yellow, and black are used.

Figure 3:
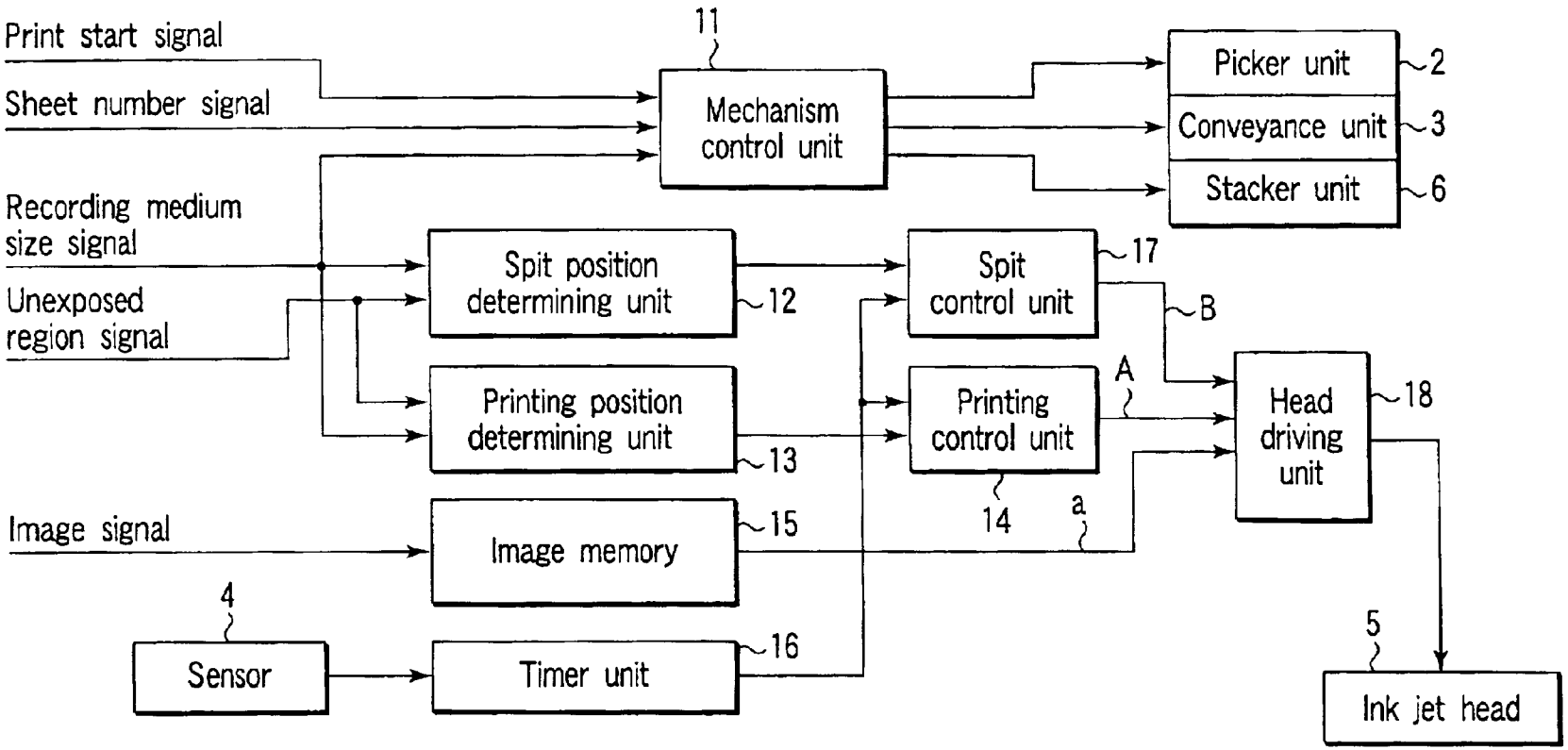
FIG. 3 is a block diagram showing a constitution of a control unit in the first embodiment.

FIG. 3 is a block diagram showing a constitution of a control unit. A print start signal, sheet number signal indicating the number of prints, and recording medium size signal indicating a size of the recording medium 1 are inputted to a mechanism control unit 11 which controls the picker unit 2, conveyance unit 3, and stacker unit 6. The recording medium size signal indicates the length of the conveyance direction of the recording medium 1 and the width of the direction crossing at right angles to the conveyance direction.

The mechanism control unit 11 controls the conveyance unit 3 and picker unit 2, so that the number of sheets of the recording medium 1 indicated by the sheet number signal are laid onto the conveyance unit 3 from the picker unit 2 at a predetermined interval, and the conveyance unit 3 conveys the recording medium 1 at a constant speed. For example, when the length of the conveyance direction of the recording medium 1 is 1000 mm, and the conveyance speed of the conveyance unit 3 is 1000 mm/sec, the recording medium 1 is laid onto the conveyance unit 3 from the picker unit 2 at an interval of 1.1 sec including an interval of 0.1 sec for the sensor 4 to detect the recording medium 1.

Moreover, the recording medium size signal and unexposed region signal (unexposed region information) indicating an unexposed region are inputted into a spit position determining unit 12 which determines a spit position on the recording medium 1. Here, the unexposed region information defines regions on the recording medium surface, which are unexposed or cut away after printing and processing, such as a trim region, a paste region and fold region. Similarly, the recording medium size signal and unexposed region signal are inputted to a printing position determining unit 13 for determining a position of the recording medium 1 in which an image is to be printed.

The spit position determining unit 12 determines a position of the recording medium 1 in which the spit is possible, and supplies time the spit position reaches the ink jet head 5 and position information to a spit control unit 17. That is, the spit position determining unit 12 recognizes a region to be spitted from the unexposed region signal, and calculates time the spit position reaches the ink jet head 5 from the conveyance speed.

The printing position determining unit 13 recognizes a portion to be printed from the unexposed region signal, calculates time a printing position reaches the ink jet head 5 from the conveyance speed, and thereby determines a position in which the image is to be printed. Subsequently, on determining the printing position, the unit supplies information of a time the printing position reaches the ink jet head 5 and information of the position to a printing control unit 14. Moreover, an image signal is stored in an image memory 15. A detection signal from the sensor 4 is inputted to a timer unit 16 which measures time.

The timer unit 16 counts time after the sensor 4 detects the top position of the recording medium 1, and supplies timer information to the spit control unit 17 and printing control unit 14. The spit control unit 17 compares time the calculated spit position reaches the ink jet head 5 with the timer information from the timer unit 16, and supplies a signal B designating a drive element of the spit to a head driving unit 18, when the timer information agrees with time the spit position reaches the ink jet head 5. The head driving unit 18 drives the designated drive element of spit in the ink jet head 5 in response to the signal B to spit ink onto the recording medium 1.

The printing control unit 14 compares the time the calculated printing position reaches the ink jet head 5 with the timer information from the timer unit 16, and supplies a signal A for enable the head driving unit 18 to perform image printing, when the timer information agrees with the time the printing position reaches the ink jet head 5. An image signal a is read from the image memory 15 and supplied to the head driving unit 18. The head driving unit 18 drives the ink jet head 5 in response to the driving signal A and image signal a to print the image on the recording medium 1.

In this constitution, the recording medium size signal indicates sizes of the direction crossing at right angles to the conveyance direction (hereinafter referred to as an X direction) and conveyance direction (hereinafter referred to a Y direction), and the unexposed region signal indicates a region (X1,Y1)–(X2,Y2).

Figure 4:
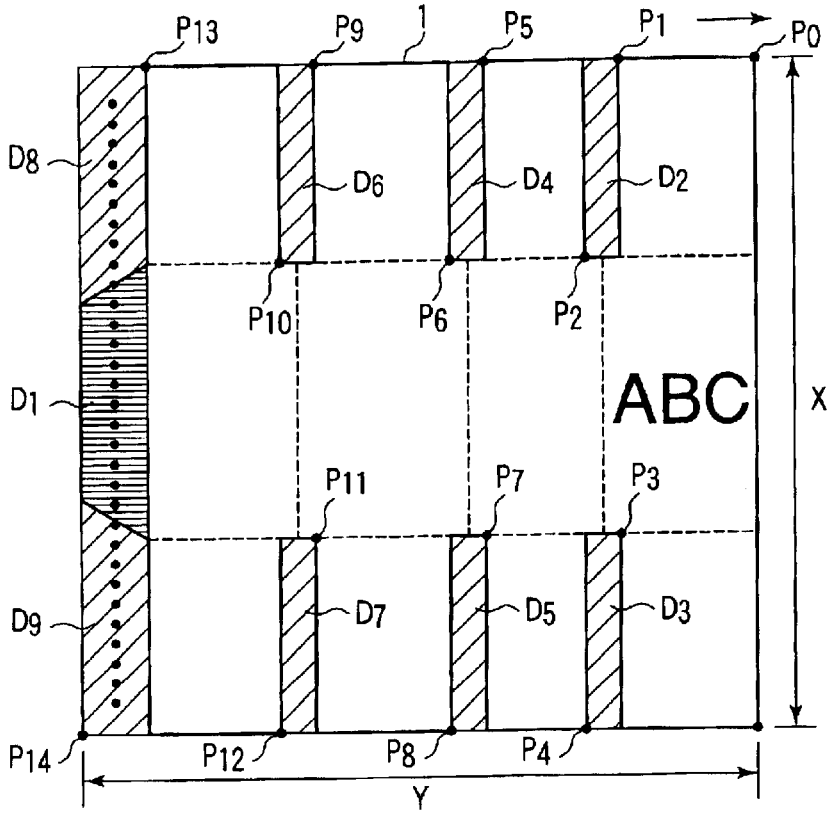
FIG. 4 is a diagram showing a constitution of a recording medium for use in the first embodiment.

For example, as shown in FIG. 4, when a recording medium having sizes of 1000 mm in the X direction and 1000 mm in the Y direction is used as the recording medium 1, the recording medium size signal can be represented as (1000, 1000).

Moreover, in the recording medium 1, a region $D_1$ shown by transverse lines denotes a paste region, and regions $D_2$, $D_3$, $D_4$, $D_5$, $D_6$, $D_7$, $D_8$, $D_9$ shown by slant lines denote trim regions. In this manner, in the recording medium 1, the trim regions $D_2$ to $D_9$ and paste region $D_1$ exist in a mixed manner in the arrangement direction of the ink discharge nozzles, that is, in the X direction. For example, regions $D_8$, $D_1$, $D_9$ form an unexposed region disposed continuously in the X direction.

Assuming that a right upper end position $P_0$ of the recording medium 1 is (0,0), and left lower end position $P_{14}$ is (1000,1000), the unexposed region signal which designates the region $D_2$ can be represented by $P_1$–$P_2$, that is, (0,200)–(300,250). The unexposed region signal which designates the region $D_3$ can be represented by $P_3$–$P_4$, that is, (700,200)–(1000,250); the unexposed region signal which designates the region $D_4$ can be represented by $P_5$–$P_6$, that is, (0,400)–(300,450); the unexposed region signal which designates the region $D_5$ can be represented by $P_7$–$P_8$, that is, (700,400)–(1000,450); the unexposed region signal which designates the region $D_6$ can be represented by $P_9$–$P_{10}$, that is, (0,650)–(300,700); the unexposed region signal which designates the region $D_7$ can be represented by $P_{11}$–$P_{12}$, that is, (700,650)–(1000,700); and the unexposed region signal which designates the region $D_1+D_8+D_9$ can be represented by $P_{13}$–$P_{14}$, that is, (0,850)–(1000,1000).

Therefore, the spit position determining unit 12 can determine the spit position with respect to the unexposed region from the recording medium size signal and unexposed region signal. Moreover, conversely, the printing position determining unit 13 can determine the printing position with respect to the region excluding the unexposed region. Furthermore, portions surrounded with bold lines in FIG. 4 are portions for use in the final box making step.

When the recording medium 1 is conveyed on the conveyance unit 3, first the sensor 4 detects the top position of the recording medium 1. Thereby, the timer unit 16 starts counting time. The printing position determining unit 13 determines the region to be printed from the unexposed region signal, and calculates the time the printing position reaches the ink jet head 5 from the conveyance speed. Moreover, when the calculated time the printing position reaches the ink jet head 5 agrees with a counted time of the timer unit 16, the printing control unit 14 supplies the signal A to the head driving unit 18. At this time, the image memory 15 also supplies the image signal a to the head driving unit 18, and the head driving unit 18 drives the ink jet head 5 to print the recording medium 1. For example, characters "ABC" as shown in FIG. 4 are printed.

On the other hand, the recording medium size signal and unexposed region signal are also supplied to the spit position determining unit 12, and the spit position determining unit 12 determines the position of the recording medium 1 in which the spit is possible. Subsequently, time information that the spit position reaches the ink jet head 5 and position information are supplied to the spit control unit 17. When the time that the spit position reaches the ink jet head 5 agrees with the counted time of the timer unit 16, the spit control unit 17 supplies the signal B for the spit to the head driving unit 18.

Thereby, the ink jet head 5 spits the ink to the unexposed region on the recording medium 1. For example, as shown by black dots in FIG. 4, when the regions $D_8$, $D_1$, $D_9$ are used to perform the spit, the spit is possible with respect to all the ink discharge nozzles of the ink jet head 5 at the same timing.

Figure 5A:
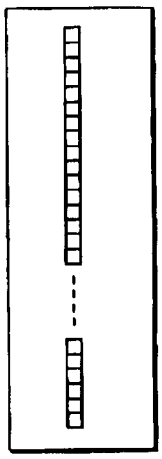
FIGS. 5A to 5D are diagrams showing one example of spit of an ink jet head in the first embodiment.
Figure 5B:
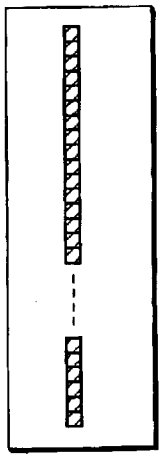
Figure 5C:
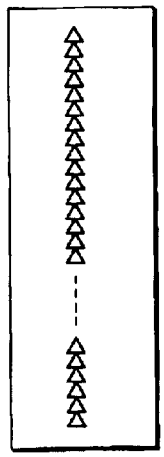
Figure 5D:
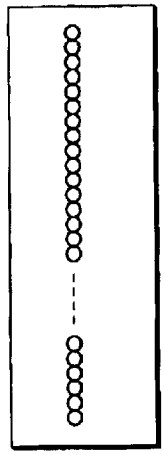

In this case, when the ink jet head 5 consists of four heads for four colors of cyan, magenta, yellow, and black, the regions $D_8$, $D_1$, $D_9$ are used to perform the spit with respect to a 4n-th ($n \geqq 1$) sheet of recording medium 1 from the black head as shown by □ dots in FIG. 5A. Moreover, the spit is performed with respect to a (4n−1)-th sheet of recording medium 1 from the yellow head as shown by □ dots including slant lines in FIG. 5B, with respect to a (4n−2)-th sheet of recording medium 1 from the magenta head as shown by Δ dots in FIG. 5C, and with respect to a (4n−3)-th sheet of recording medium 1 from the cyan head as shown by ○ dots in FIG. 5D.

As described above, for the recording medium, even when only the trim regions are not sufficient for the spit of all the ink discharge nozzles, two unexposed regions including the trim and paste regions can be used to perform the spit of all the ink discharge nozzles. Therefore, for the spit, it is unnecessary to move the ink jet head to a separate place for the spit, a spit operation can be performed as a part of a printing operation, and the efficiency of maintenance can be enhanced. Therefore, the efficiency of printing can be enhanced.

A method of the spit in case the ink jet head 5 consists of four heads for four colors of cyan, magenta, yellow, black is not limited to the method shown in FIG. 5. For example, a method shown in FIG. 6 may also be carried out. That is, the regions $D_8$, $D_1$, $D_9$ are used: to repeat the spit with respect to the 4n-th ($n \geqq 1$) sheet of recording medium 1 in order of magenta, yellow, black, cyan from an end as shown in FIG.

Figure 6A:
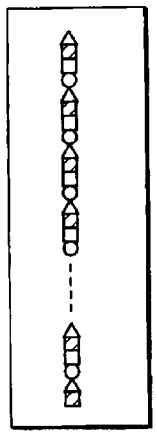
FIGS. 6A to 6D are diagrams showing another example of the spit of the ink jet head in the first embodiment.
Figure 6B:
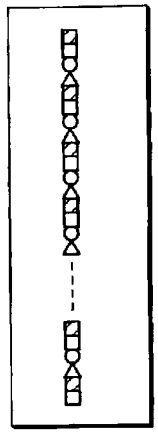
Figure 6C:
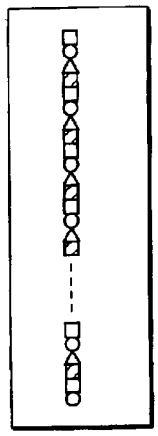
Figure 6D:
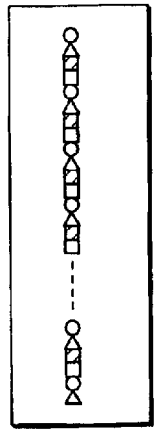

6A; to repeat the spit with respect to the (4n−1)-th sheet of recording medium 1 in order of yellow, black, cyan, magenta from the end as shown in FIG. 6B; to repeat the spit with respect to the (4n−2)-th sheet of recording medium 1 in order of black, cyan, magenta, yellow from the end as shown in FIG. 6C; and to repeat the spit with respect to the (4n−3)-th sheet of recording medium 1 in order of cyan, magenta, yellow, black from the end as shown in FIG. 6D.

Even in this case, the efficiency of maintenance can be enhanced.

Figure 7:
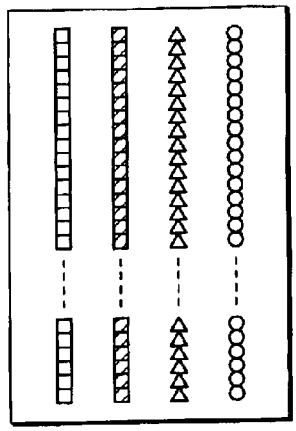
FIG. 7 is a diagram showing another example of the spit of the ink jet head in the first embodiment.

Moreover, when the regions $D_8$, $D_1$, $D_9$ have certain degrees of widths in the Y direction, as shown in FIG. 7, the spit may successively be performed in the same region from four heads of cyan, magenta, yellow, black. Furthermore, two unexposed regions including the trim and paste regions may also be used to perform a usual printing, for example, to perform the spit with respect to nozzles other than the nozzle used in printing "ABC" of FIG. 4.

(Second Embodiment)

It is to be noted that the same part as that of the first embodiment is denoted with the same reference numeral and detailed description thereof is omitted.

Figure 8:
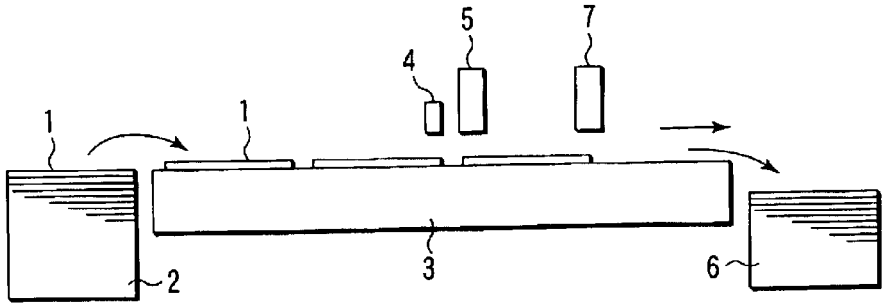
FIG. 8 is a diagram showing the constitution of the printing process according to a second embodiment of the present invention.

In a second embodiment, as shown in FIG. 8, a pattern read unit 7 such as CCD sensor which reads the nozzle check pattern is disposed on a downstream side of the ink jet head 5 in the conveyance direction of the recording medium 1.

Figure 9:
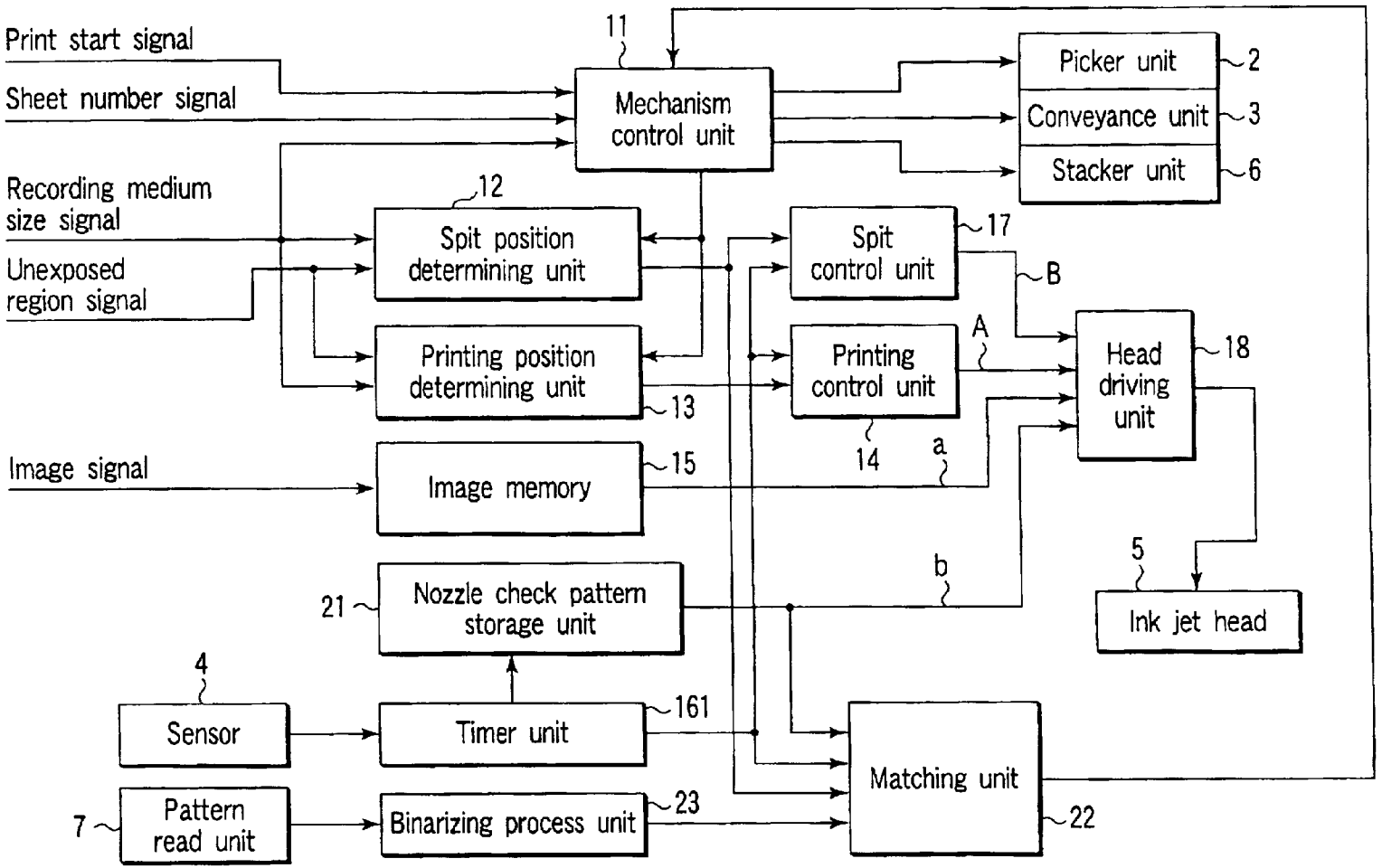
FIG. 9 is a block diagram showing a constitution of the control unit in the second embodiment.

Moreover, for the constitution of the control unit, as shown in FIG. 9, a counter unit 161 in which a counter is separately disposed is used as a counter unit to start a time count operation, when the sensor 4 detects the top position of the recording medium 1. Every time the sensor 4 detects the top position of the recording medium 1, the unit changes a content of the counter to "1"→"2"→"3"→"4"→"1"→"2". . . , and inputs the content into a nozzle check pattern storage unit 21.

The nozzle check pattern storage unit 21 respectively stores a reference nozzle check pattern of four colors including cyan, magenta, yellow, black, and successively respectively supplies a four-colors reference nozzle check pattern b to the head driving unit 18 and matching unit 22 in accordance with a count content from the counter unit 161.

Moreover, time count information from the counter unit 161, spit position signal and time information that the spit position reaches the ink jet head 5 from the spit position determining unit 12, and data obtained by binarizing pattern information read by the pattern read unit 7 by a binarizing process unit 23 are inputted into the matching unit 22.

Figure 10:
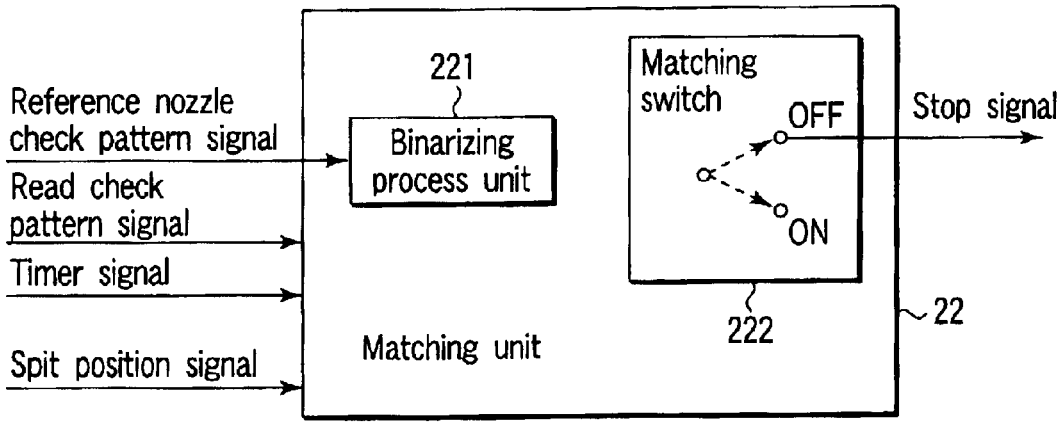
FIG. 10 is a block diagram showing a matching unit in FIG. 9.

As shown in FIG. 10, the matching unit 22 includes a binarizing process unit 221 and matching switch 222, and the reference nozzle check pattern from the nozzle check pattern storage unit 21 is binarized by the binarizing process unit 221. Moreover, the binarized reference nozzle check pattern is compared with the data which is read by the pattern read unit 7 and binarized by the binarizing process unit 23. With agreement, the matching switch 222 is turned on. When disagreement is detected, the matching switch 222 is turned off, and a stop signal is sent to the mechanism control unit 11.

With the input of the stop signal, the mechanism control unit 11 simultaneously outputs the stop signal also to the spit position determining unit 12 and printing position determining unit 13, and stops the printing operation by the ink jet head 5. Moreover, at this time, the operations of the picker unit 2, conveyance unit 3, and stacker unit 6 are also stopped.

In this constitution, when the spit position determining unit 12 determines a spit possible position, the unit supplies the time that the determined spit position reaches the ink jet head 5 and position information to the spit control unit 17. The spit control unit 17 supplies the signal B for the spit to the head driving unit 18, when the time that the spit position reaches the ink jet head 5 agrees with the counted time of the counter unit 161.

On the other hand, the nozzle check pattern storage unit 21 reads and outputs the corresponding reference nozzle check pattern b to the head driving unit 18 and matching unit 22.

Therefore, the head driving unit 18 drives the ink jet head 5 to print a pattern based on the nozzle check pattern b in the spit position of the recording medium 1. For the pattern, for example, as shown in FIG. 11, the nozzle check pattern in which each ink discharge nozzle repeats the same pattern including three dots every two dots is printed in the unexposed region of the recording medium 1.

The printed nozzle check pattern is read by the pattern read unit 7, binarized by the binarizing process unit 23, and subsequently supplied to the matching unit 22. The matching unit 22 detects the agreement or disagreement by comparing the reference nozzle check pattern from the nozzle check pattern storage unit 21 with the nozzle check pattern read by the pattern read unit 7 and then binarized by binarizing process unit 23.

Figure 11:
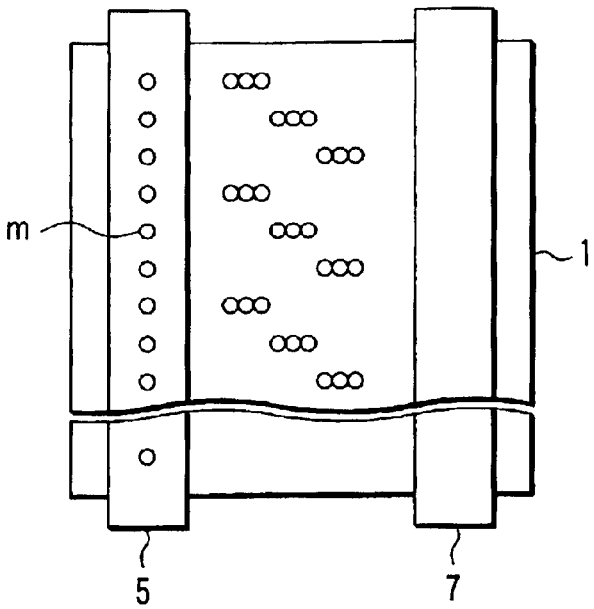
FIG. 11 is a diagram showing a normal printing example at a time when a nozzle check pattern is used to perform the spit in the second embodiment.

For example, noting a fifth ink discharge nozzle m of the ink jet head 5, and assuming that the nozzle check pattern is printed as shown in FIG. 11, a signal of the reference nozzle check pattern shown in FIG. 13A agrees with a signal of the nozzle check pattern read by the pattern read unit 7 as shown in FIG. 13B. However, when the printed nozzle check pattern is in a state that a position corresponding to the ink discharge nozzle m is not printed as shown in FIG. 12, the signal of the nozzle check pattern read by the pattern read unit 7 is as shown in FIG. 13C, and disagrees with the signal of the reference nozzle check pattern shown in FIG. 13A. Thereby, the fifth ink discharge nozzle m is detected to be a defective nozzle.

When the matching unit 22 detects the disagreement of the signals, the stop signal is supplied to the mechanism control unit 11, spit position determining unit 12, and printing position determining unit 13, and the printing by the ink jet head 5 is thereby stopped. Moreover, the operations of the picker unit 2, conveyance unit 3, and stacker unit 6 are also simultaneously stopped.

Moreover, when the nozzle is clogged and the printed dot is small, the signal of the nozzle check pattern read by the pattern read unit 7 is as shown in FIG. 13D. Even in this case, the matching unit 22 judges the disagreement with the reference nozzle check pattern. Furthermore, when an ink discharge timing of the nozzle deviates, the signal of the nozzle check pattern read by the pattern read unit 7 is as shown in FIG. 13E. Even in this case, the matching unit 22 judges the disagreement with the reference nozzle check pattern.

As described above, when the nozzle check pattern for checking the nozzle is used to perform the spit operation, both the spit and nozzle check can be performed, and the efficiency of maintenance of the ink jet head 5 can further be enhanced. Thereby, the printing efficiency can further be enhanced.

(Third Embodiment)

It is to be noted that the same part as that of the first and second embodiments is denoted with the same reference numeral and the detailed description thereof is omitted.

Figure 14:
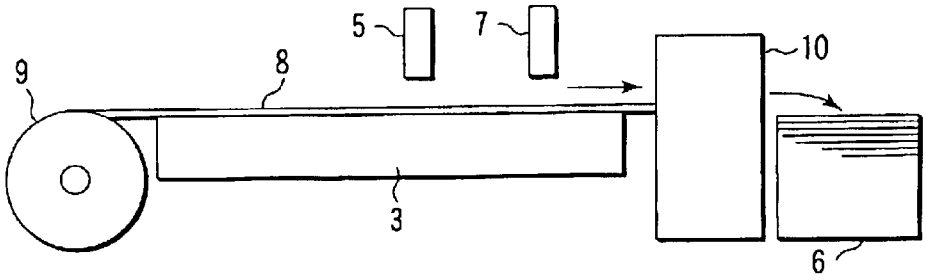
FIG. 14 is a diagram showing a constitution of the printing process according to a third embodiment of the present invention.

In a third embodiment, as shown in FIG. 14, a roll sheet 8 is used as the recording medium. A roll sheet supply unit 9 feeds the roll sheet 8 onto the conveyance unit 3, the nozzle check pattern is printed in a predetermined unexposed region by the ink jet head 5, and subsequently the pattern read unit 7 reads the printed pattern. Thereafter, the roll sheet 8 is cut into a required shape by punching by a trim mechanism 10 and contained in the stacker unit 6.

This roll sheet 8 is used as a recording medium, for example, in bookbinding. In this case, the unexposed region in which trim, paste, and fastening regions exist in a mixed manner in the X direction is used to print the nozzle check pattern.

Even when the roll sheet 8 is used as the recording medium, the efficiency in performing the maintenance can similarly be enhanced, and thereby the printing efficiency can further be enhanced.

It is to be noted that in the above-described embodiments, two or more unexposed regions such as the trim, paste, fold, and fastening regions are continuously disposed in the X direction crossing at right angles to the conveyance direction of the recording medium, and in the regions the spit is performed and the nozzle check pattern is recorded. This example has been described above, but the present invention is not necessarily limited to the example, and the present invention can also be applied to a case in which two or more unexposed regions are not continuously disposed in the X direction.

Figure 15:
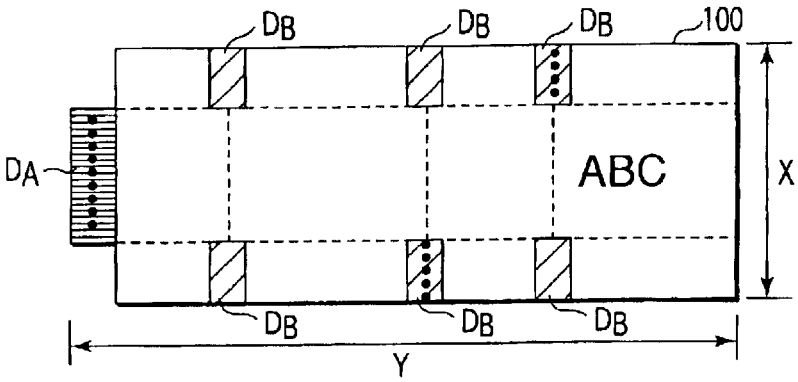
FIG. 15 is a diagram showing another constitution example of the recording medium.

That is, as shown in FIG. 15, with respect to a recording medium 100 in which a paste region $D_A$ is apart from a trim region $D_B$ in the X direction, a nozzle for performing the spit or recording the nozzle check pattern with respect to the paste region $D_A$ is driven at a timing different from that of a nozzle for performing the spit or recording the nozzle check pattern with respect to the trim region $D_B$. Thereby, the spit can be performed or the nozzle check pattern can be recorded with respect to all the ink discharge nozzles of the ink jet head.

Even in this case, since the spit or nozzle check pattern recording can be performed as a part of the printing operation, the efficiency of maintenance can be enhanced.

Figure 16:
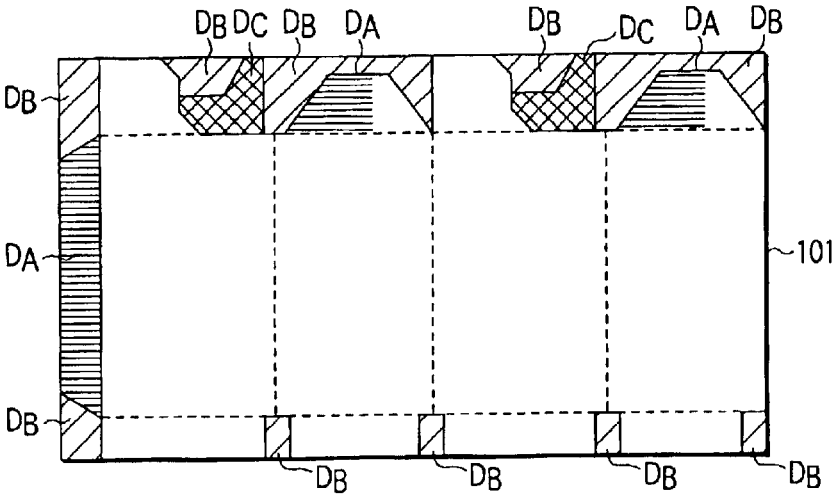
FIG. 16 is a diagram showing another constitution example of the recording medium.

Furthermore, FIG. 16 shows a recording medium 101 in which the paste region $D_A$, trim region $D_B$, and fold region $D_C$ exist in a complicatedly mixed manner. Two or more unexposed regions of the paste region $D_A$, trim region $D_B$, and fold region $D_C$ can be used to perform the spit or nozzle check pattern recording even with respect to the recording medium 101.

It is to be noted that in the above-described embodiments the spit of the ink jet head or the spit using the nozzle check pattern recording is performed. This has been described above, but the present invention is not necessarily limited to this, and the present invention may also be applied to a case in which only the nozzle check pattern recording is performed.

It is to be noted that in the above-described embodiments the spit of the ink jet head or the spit using the nozzle check pattern recording is performed with respect to the region including the trim region. However, the spit may also be performed with respect to the region existing on the processed recording medium among the regions which are processed and thereby unexposed to the surface, excluding the trim region and including the paste and fold regions.

Furthermore, aforementioned paste region may includes a region which is not used for adhere the recording medium, but sealed, and therefore unexposed to the surface.

Moreover, in the above-described embodiments, the ink jet head in which the ink discharge nozzles are arranged to cross at right angles to the conveyance direction of the recording medium has been described as an example, but the present invention is not necessarily limited to this. In the ink jet head, the ink discharge nozzles may also be arranged obliquely with respect to the conveyance direction of the recording medium. In short, the ink discharge nozzles may be arranged to cross with respect to the conveyance direction of the recording medium in the ink jet head.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An ink jet recording apparatus to perform printing on a recording medium in which two or more unexposed regions subjected to processing such as trimming, pasting and folding after the printing and thereby unexposed exist in a mixed manner, comprising:

an ink jet head in which a plurality of ink discharge nozzles are arranged to cross with respect to a conveyance direction of the recording medium;

a spit position determining unit which determines a spit position based on size information and unexposed region information of the recording medium; and a spit control unit which controls spit of the ink jet head based on a spit position judgment result of the spit position determining unit, wherein said unexposed region information defines regions on the recording medium surface which are unexposed or cut away after printing and processing, and said spit position determining unit selects two or more unexposed regions and determines the spit position so that all the ink discharge nozzles perform the spit.

2. The ink jet recording apparatus according to claim 1, wherein the spit position determining unit selects two or more unexposed regions and determines the spit position so that all the ink discharge nozzles excluding the nozzle used in the printing of ink jet head perform the spit.

3. The ink jet recording apparatus according to claim 1, further comprising:

a storage unit which is constituted to store a nozzle check pattern for confirming an ink discharge state from each ink discharge nozzle, wherein the spit control unit controls the spit of the ink jet head in accordance with the nozzle check pattern stored in the storage unit.

4. The ink jet recording apparatus according to claim 1, further comprising:

a pattern read unit which reads a nozzle check pattern recorded on the recording medium; and a matching unit which compares the nozzle check pattern read by the pattern read unit with a nozzle check pattern stored in a storage unit to detect the ink discharge nozzle to be good or not.

5. An ink jet recording apparatus which performs printing on a recording medium to be subjected to processing such as pasting and folding after the printing, comprising:

an ink jet head in which a plurality of ink discharge nozzles are arranged to cross with respect to a conveyance direction of the recording medium;

a spit position determining unit which determines a spit position based on size information of the recording medium, and region information existing on the processed recording medium among unexposed region information; and a spit control unit which controls spit of the ink jet head based on a spit position judgment result of the spit position determining unit, wherein said unexposed region information defines a region on the recording medium surface which is unexposed after printing and processing.

6. The ink jet recording apparatus according to claim 5, wherein the spit position determining unit selects two or more unexposed regions and determines the spit position so that all the ink discharge nozzles excluding the nozzle used in the printing of ink jet head perform the spit.

7. The ink jet recording apparatus according to claim 5, further comprising:

a storage unit which is constituted to store a nozzle check pattern for confirming an ink discharge state from each ink discharge nozzle, wherein the spit control unit controls the spit of the ink jet head in accordance with the nozzle check pattern stored in the storage unit.

8. The ink jet recording apparatus according to claim 5, further comprising:

a pattern read unit which reads a nozzle check pattern recorded on the recording medium; and a matching unit which compares the nozzle check pattern read by the pattern read unit with a nozzle check pattern stored in a storage unit to detect the ink discharge nozzle to be good or not.

* * * * *